US006829447B2

(12) United States Patent
Okano

(10) Patent No.: US 6,829,447 B2
(45) Date of Patent: Dec. 7, 2004

(54) DEVELOPING APPARATUS

(75) Inventor: Keiji Okano, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/006,680

(22) Filed: Dec. 10, 2001

(65) Prior Publication Data

US 2002/0164174 A1 Nov. 7, 2002

(30) Foreign Application Priority Data

Dec. 11, 2000 (JP) ..... 2000-376441

(51) Int. Cl.[7] ..... G03G 15/06
(52) U.S. Cl. ..... 399/55; 399/285
(58) Field of Search ..... 399/53, 55, 270, 399/285

(56) References Cited

U.S. PATENT DOCUMENTS 5,416,568 A * 5/1995 Yoshiki et al. ..... 399/285
5,815,768 A * 9/1998 Clifton ..... 399/55 X
5,950,042 A * 9/1999 Goto et al. ..... 399/53
6,052,544 A * 4/2000 Shimizu et al. ..... 399/55
6,167,212 A 12/2000 Satoh et al. ..... 399/55

FOREIGN PATENT DOCUMENTS

JP 58-32375 2/1983
JP 2000-98710 4/2000

* cited by examiner

*Primary Examiner*—Sandra L. Brase
(74) *Attorney, Agent, or Firm*—Fitzpatrick, Cella, Harper & Scinto

(57) ABSTRACT

A developing apparatus includes developer carrying member for carrying a developer; wherein the developer carrying member is supplied with a developing voltage comprising a superimposed DC voltage component and AC voltage component to develop an electrostatic latent image formed on an image bearing member; switching means for switching an image density of a developed image on the image bearing member; wherein when the image density of the developed image is made higher than a predetermined image density in accordance with an output of the switching means, the frequency of the AC voltage component is made higher than a predetermined frequency.

10 Claims, 4 Drawing Sheets

DEVELOPING APPARATUS

FIELD OF THE INVENTION AND RELATED ART

The present invention relates to a developing apparatus for developing an electrostatic latent image formed on an image bearing member. In particular, it relates to a developing apparatus which is employed in a copying machine, a printer, a facsimile machine, or the like.

In an image forming apparatus such as an electrophotographic copying machine, an electrophotographic printer, and the like, an electrostatic latent image formed on a photoconductive member by exposing the photoconductive member to an optical image in accordance with an intended image, is visualized, that is, developed into a visual image, by adhering the developer borne on a developer bearing member to the latent image on the photoconductive member, by forming an electric field in a development station in which the portion of the photoconductive member, across which the latent image is borne, and the portion of the developer bearing member, across which developer is borne, oppose each other.

As for a developing method, a jumping developing method (Japanese Patent Application Publication No. 58-32375) is widely known. In a jumping developing method, an electrostatic latent image is developed by applying development bias, which is a combination of a DC voltage and a AC voltage having a rectangular waveform, to a development sleeve (developer bearing member) disposed in a manner to hold a predetermined gap relative to the photoconductive member. As the development bias is applied to the development sleeve, the developer particles are oscillated, by the alternating component of the development bias, in the predetermined gap between the development sleeve and the photoconductive member, in the direction virtually in parallel with the line connecting the centers of the axes of the development sleeve and photoconductive member. As a result, the developer particles on the photoconductive member are adhered to the electrostatic latent image on the photoconductive member; in other words, the latent image is developed.

In order to allow a user to obtain an image preferable to the user, a substantial number of image forming apparatuses which employ electrophotographic technologies are provided with a density adjusting apparatus. In theme image forming apparatuses, the amount of developer adhesion is adjusted by adjusting the development contrast, that is, the difference between the potential level of the image portions of the electrostatic latent image on the photoconductive member, and the potential level of the DC component of the development bias, by adjusting the DC component of the development bias.

In some of the known methods for adjusting the density by controlling the bias voltage, the magnitude of the DC voltage, which is applied to a development sleeve in combination with AC voltage having a rectangular waveform, is changed. For example, in order to increase the density, the amount by which the developer particles adhere to the image bearing member is increased by raising the DC voltage to increase transfer voltage (component of the development voltage which induces developer particles to jump, or transfer, from the development sleeve to the photoconductive member).

In other known types of the density adjusting methods, the development density is changed by changing the ratio of the duration of the reverse transfer voltage (component which induces developer particles to transfer back from the photoconductive member to the development sleeve) relative to the duration of the transfer voltage, instead of varying the magnitudes of the transferring and/or reversely transferring components of the bias voltage. For example, in order to increase the density, the duration of the transfer voltage is increased relative to the duration of the reverse transfer voltage, because such an adjustment increases the amount by which developer adheres to the image bearing member, increasing thereby the density.

However, in both types of methods, the transfer voltage and reversal contrast (difference between the potential level of the non-image portion of the electrostatic latent image on the photoconductive member, and the potential level of the DC component of the development bias) increase in magnitude in the high density range and low density range, resulting in background fog and/or reversal fog, which are unignorable problems in some cases.

More specifically, an attempt to increase the image density to a level higher than a predetermined level increases the magnitude of the transfer voltage, which causes developer to adhere to not only the image portions but also non-image portions, resulting in increases in the so-called background fog. On the other hand, an attempt to reduce the image density to a level below a predetermined level increases the magnitude of the reversal contrast (difference in potential level between the reverse transfer voltage and the dark portions of the photoconductive member), by which the developer particles, which are inherently chargeable to the negative polarity, and yet have been charged to the positive polarity, are substantially affected, increasing the amount by which the reversal fog is produced.

In the case of the method for increasing the density of the developer image by increasing the ratio of the duration of the transfer voltage relative to the duration of the reverse transfer voltage, instead of changing in magnitude the transfer and/or reverse transfer voltages of the bias voltage, the amount of the background fog tends to increase due to the increase in the duration of the transfer voltage.

Thus, a method for reducing the background fog has been proposed. More specifically, a method for increasing the density of a developer image by increasing the ratio of the duration of the transfer voltage relative to the duration of the reverse transfer voltage, while reducing the magnitude of the development contrast (difference in potential level between the transfer voltage and the image portions of the electrostatic latent image), has been proposed in Japanese Laid-open Patent Application 2000-98710. However, from the standpoint of increasing the image density while preventing the occurrence of the background fog, this patent application is desired to be further improved.

SUMMARY OF THE INVENTION

The primary object of the present invention is to provide a developing apparatus capable of preventing the occurrence of such fog that tends to occur when increasing the density of a developer image.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, a developing apparatus and an image forming apparatus in accordance with the present invention will be described in more detail with reference to the appended drawings.

Embodiment 1

Figure 1:
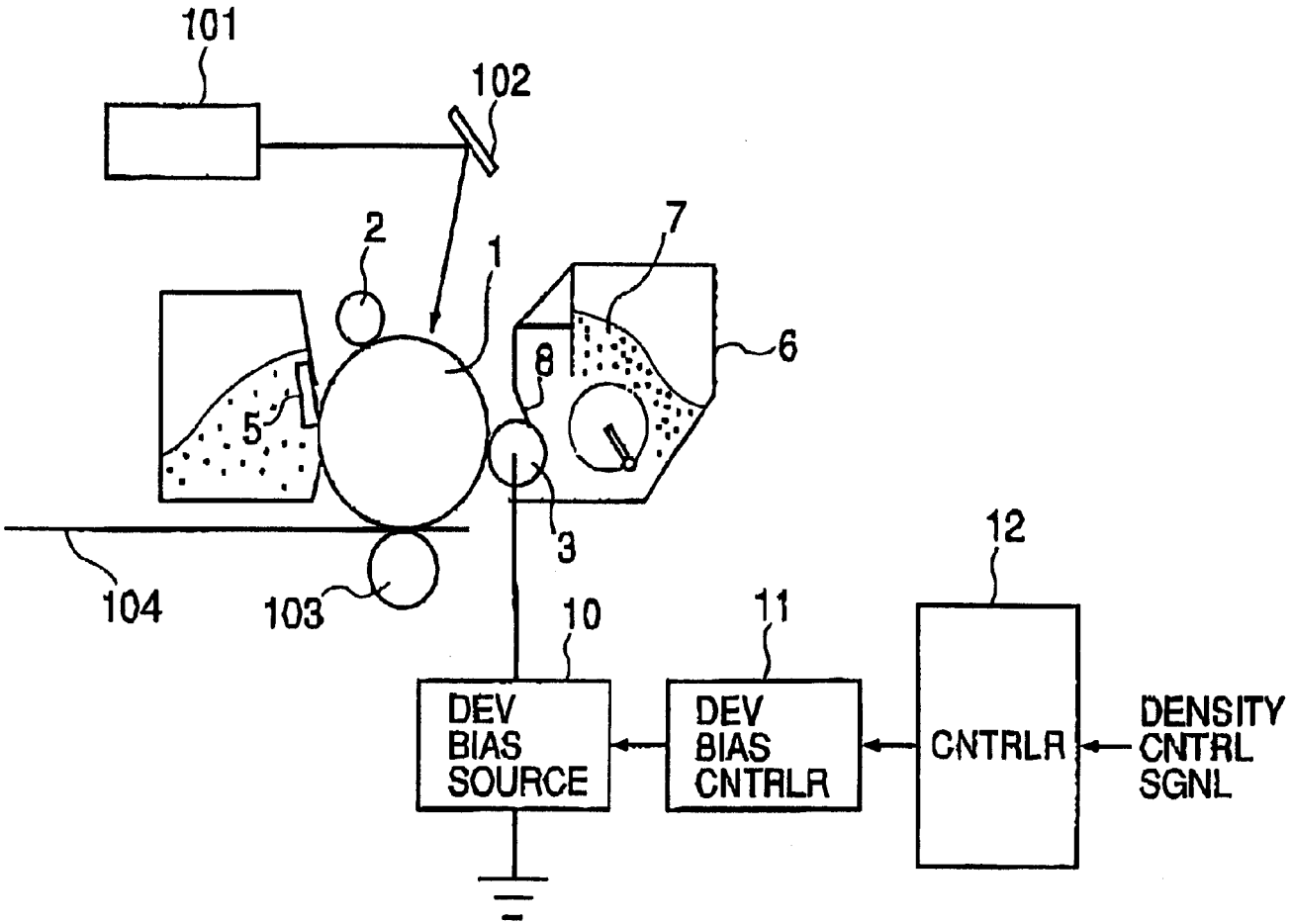
FIG. 1 is a schematic drawing of the image forming apparatus in the first embodiment of the present invention.
Figure 2:
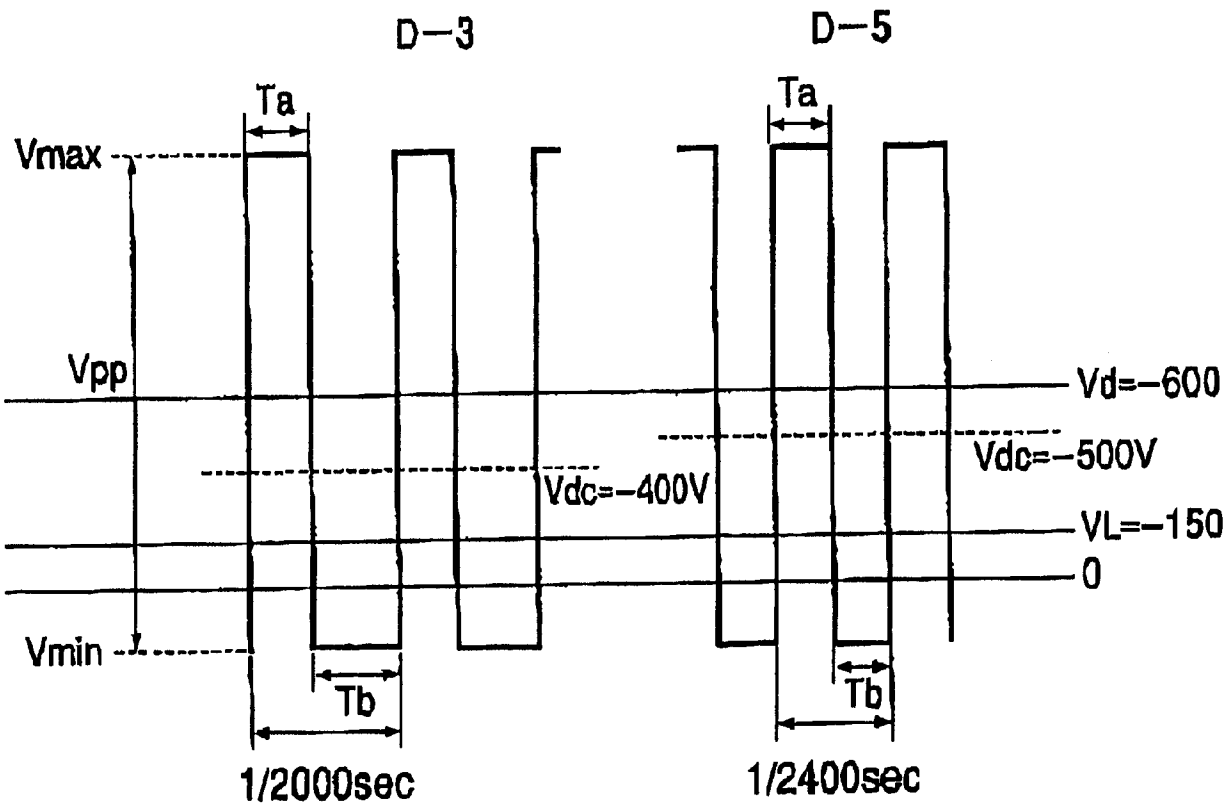
FIG. 2 shows two waveforms of the development bias when the development density has been adjusted to density values of D-3 and D-5, respectively, by the density adjusting method in accordance with the present invention.

Referring to FIGS. 1 and 2, an example of an image forming apparatus in accordance with the present invention, and an example of a developing apparatus in accordance with the present invention, will be described. First, the essential portions of the electrophotographic image forming apparatus in accordance with the present invention will be described with reference to FIG. 1.

This image forming apparatus has a photoconductive drum 1 as an image bearing member, which is a cylindrical electrophotographic photoconductive member (inherently negatively changeable). The peripheral surface of the photoconductive drum 1 is uniformly charged by a charging means 2 while the photoconductive drum 1 is rotationally driven. The uniformly charged peripheral surface of the photoconductive drum 1 is exposed by an exposing apparatus 101 and a reflection mirror 102 to an optical image. As a result, an electrostatic latent image is formed on the peripheral surface of the photoconductive drum 1. This latent image is developed in reverse by a developing apparatus 6, which uses single component developer (toner inherently chargeable to negative polarity).

The developing apparatus 6 in this embodiment is provided with a development sleeve 3 as a developer bearing member, and a regulating blade 8 as a developer regulating member. As the development sleeve 3 is rotated, toner 7 stored in the developing apparatus 6 is borne on the peripheral surface of the development sleeve 3, and conveyed, while being formed into a thin layer of toner by the regulating blade 8, to a development station, in which the peripheral surfaces of the development sleeve 3 and photoconductive drum 1 oppose each other. In the development station, an electric field is formed by the development bias applied to the development sleeve 3 from an electrical power source 10. Consequently, the toner particles on the development sleeve 3 are adhered to the latent image on the photoconductive drum 1 by this electric field, developing the latent image into a toner image, that is, a visual image.

One of the essential characteristics of the present invention is that various aspects of the development process carried out in the developing apparatus are improved by devising the development bias applied to the development sleeve of this developing apparatus, in particular, that the present invention reduces the amount, by which the background fog tends to occur, when the density, at which a toner image is formed on the photoconductive drum 1, is set to a level higher the a standard level by a user. This aspect of the present invention will be described later.

The toner image formed on the peripheral surface 1 as described above is transferred onto a transfer medium 104 by a transferring means 103. The transfer medium 104 bearing the toner image is conveyed to an unshown fixing apparatus, in which the toner image is fixed to the transfer medium 104 by heat or pressure, turning into a permanent image. On the other hand, the toner particles remaining on the photoconductive drum 1 alter the transfer are removed by the blade 5 of a cleaning apparatus. Thereafter, the photoconductive drum 1 is charged again across its peripheral surface by the charging means 2 to be subjected to the above described image formation process; in other words, the photoconductive drum 1 is repeatedly subjected to the above described image forming process.

In this embodiment, the development sleeve 3 is disposed so that a predetermined gap, which is approximately 250 m, is maintained between the peripheral surfaces of the development sleeve 3 and photoconductive drum 1. To the development sleeve 3, a combination of DC and AC voltages is applied as development bias from the power source 10.

The image forming apparatus in this embodiment is provided with a density adjusting apparatus, which includes a development bias controlling portion 11 (control circuit) and a controller 12. The controller 12 controls the development bias controlling portion 11. The development bias controlling portion 11 is connected to the development bias power source 10. A user is allowed to select a desired density using the display portion, for example, a control panel, on the top side of an image forming apparatus. As a desired density level is selected, a density value adjustment signal (density switching signal) is inputted into the controller 12 to set a density value. As the density level is set, control signals related to the DC component (time average value) Vdc and frequency of development bias are sent from the controller 12 to the development bias controlling circuit 11 to switch the output of the development bias power source 10. Then, an image formation process is carried out.

In this embodiment, the density of an image obtained by developing an electrostatic latent image on the photoconductive drum is adjusted in the following manner. The development contrast (difference between the potential level of a light portion, that is, portion of the peripheral surface of the photoconductive drum, the potential level of which has been reduced by the exposure to an optical image, of an electrostatic latent image on the photoconductive drum, and the potential level of DC component Vdc) is increased by changing the DC component Vdc, in practical terms, by changing the ratio of the duration Ta of the transfer voltage Vmax relative to the duration Tb of the reverse transfer voltage Ta (this ratio is generally deemed duty ratio described below) in each cycle of the development bias. Here, the central default value (standard value) of the density is represented by a referential code D-3. Referential codes D-2 and D-1 represent the density values which are lower than the standard value, the referential code D-1 representing the lowest density, whereas referential codes D-4 and D-5 represent the density values which are higher than the standard value, the referential code D-5 representing the highest density.

FIG. 2 shows the development biases related to the development densities of D-3 and D-5, respectively.

The relationship between a duty ratio a and the time average value Vdc of the development bias voltage is:

$$\underline{a}(\%)=Ta/(Ta+Tb)\times 100:$$

Ta: duration of the transfer voltage in a single cycle of the development bias voltage Tb: duration of the reverse transfer voltage in a single cycle of the development bias voltage $$Vdc=Vmax\times\underline{a}/100+Vmin\times(1-\underline{a}/100)$$

a: duty ratio (%)

Vmax: transfer voltage (peak voltage which induces toner particles to jump from the development sleeve onto the photoconductive drum)

Vmin: reverse transfer voltage (peak voltage which induces toner particles to jump from the photoconductive drum onto the development sleeve).

In FIG. 2, a referential code Vd represents the potential level of a dark portion, or a non-image portion of the photoconductive drum (portion of an electrostatic image, which has not been exposed to an optical image), and a referential code VL represents the potential level of a light portion, or an image portion of the photoconductive drum.

In this embodiment, the development contrast is increased by increasing the duty ratio from D-1 toward D-5, in other words, by switching the development bias voltage Vdc in steps from D-1 toward D-5. Further, the frequency is increased in the higher density range, that is, when obtaining the density level of D-4 or D-5. Some of the settings in this embodiment for obtaining desired density are as follows:

Under a condition in which Vpp=1,400 V, Vmax=−1,300 V, and Vmin=−100 V, in order to obtain the density of D-3:

duty ratio=35.7%; frequency=2,000 Hz; in order to obtain the density of D-5:

duty ratio=42.9%; frequency=2,400 Hz.

At this time, the embodiment of the present invention will be described with reference to comparative examples. Comparative Example 1 is a case in which only the duty ratio a of the development bias is the some as that in this embodiment, and Comparative Example 2 is a case in which the duty ratio a of the development bias is the same as that in this embodiment, and the frequency f of this development bias is increased for all of the density levels D-1-D-5 in order to reduce the amount by which fog is created.

Figure 3:
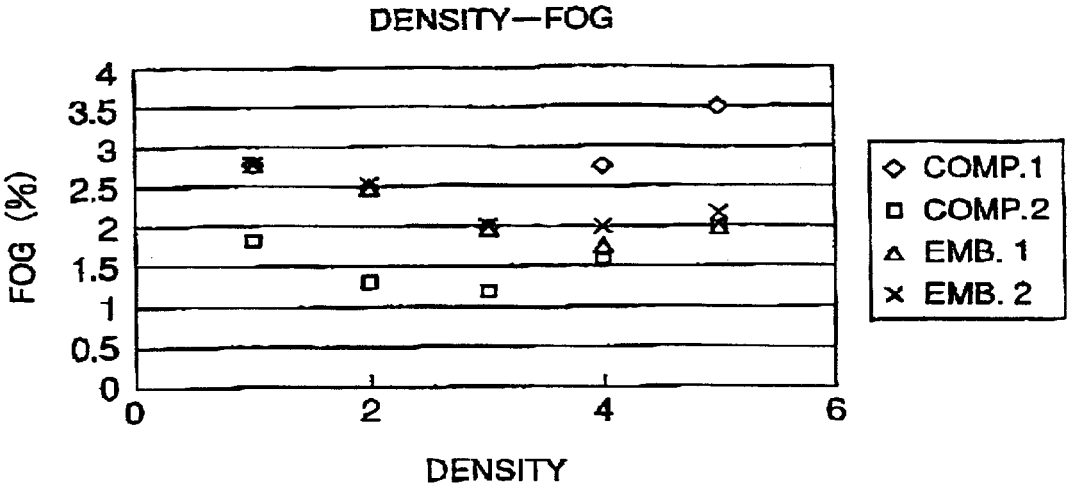
FIG. 3 is a graph showing the relationship between the density values adjusted by the density adjusting method in accordance with the present invention, and the amount of the resultant fog, along with the relationship between the density value adjusted by the comparative density adjusting methods, and the amount of the resultant fog.
Figure 4:
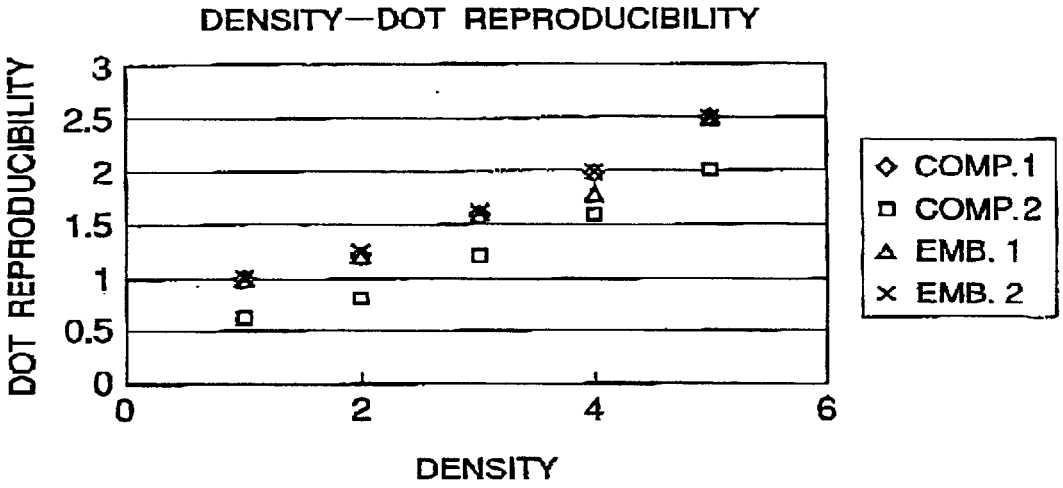
FIG. 4 is a graph showing the relationship between the density values adjusted by the density adjusting method in accordance with the present invention, and the resultant dot reproduction performance, along with the relationship between the density value adjusted by the comparative density adjusting methods, and the amount of the resultant dot reproduction performance.
Figure 5:
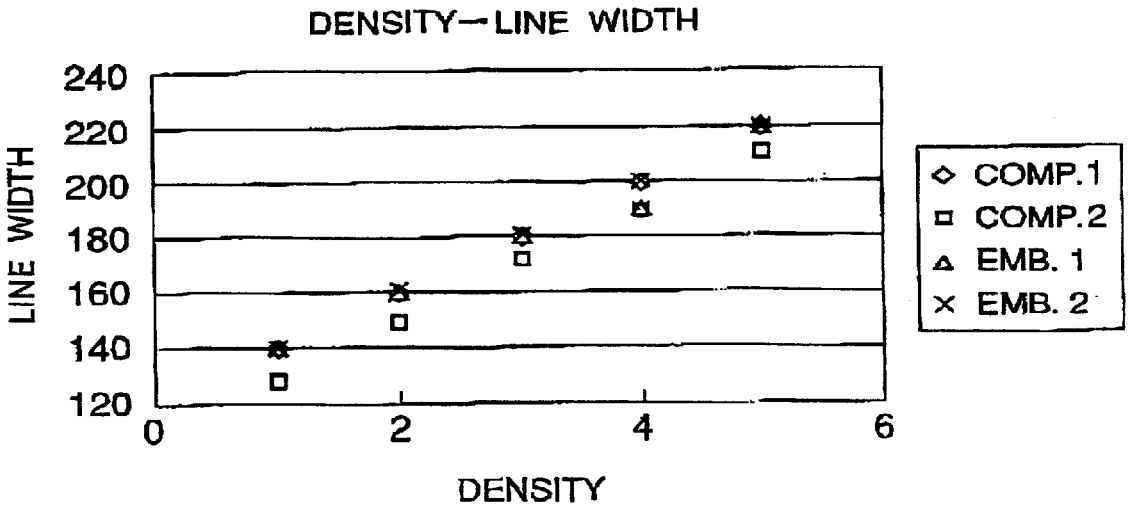
FIG. 5 is a graph showing the relationship between the density values adjusted by the density adjusting method in accordance with the present invention, and the resultant line width, along with the relationship between the density value adjusted by the comparative density adjusting methods, and the resultant line width.

Tables 1, 2, and 3, shows the bias settings in Comparative Examples 1 and 2, and the characteristics of the resultant images. The relationships between the density values and the fog, in Comparative Examples 1 and 2, and this embodiment, are shown in FIG. 3, and the relationships between the density values and dot reproducibility, in Comparative Examples 1 and 2, and this embodiment, are shown in FIG. 4. Further, the density values and line widths, in Comparative Examples 1 and 2, and this embodiment, are shown in FIG. 5. The line width in the tables and figures is the width of a line, which was printed at a resolution of 600 dpi, and the width of which is equivalent to four dots. The density of a solid image was obtained by measuring the density of a solid black image with the use of Macbeth densitometer. As for the evaluation of fog prevention performance, the difference between the maximum value (worst fog) of the measured reflective density value of a solid white area, and that of a white paper (brand-new paper) was measured. As long as the difference was below 3.0%, fog prevention performance was considered to be at a satisfactory level. As for the dot reproducibility, a single dot was printed in a square, the size of which was equivalent to 10 10 dots, at a resolution of 600 dpi, and the difference between the measured reflective density value of the square, and that of a solid white image, is measured. When the difference was no less than 1.0%, the dot reproducibility was considered to be at a satisfactory level.

TABLE 1

Comparison Example 1

| Density | Vdc | f | Line width | Density | Fog (%) | Dot (%) |
|---|---|---|---|---|---|---|
| D-1 | 300 | 2000 | 140 | 1.28 | 2.8 | 1 |
| D-2 | 350 | 2000 | 160 | 1.35 | 2.5 | 1.2 |
| D-3 | 400 | 2000 | 180 | 1.42 | 2 | 1.6 |
| D-4 | 450 | 2000 | 200 | 1.44 | 2.8 | 2 |
| D-5 | 500 | 2000 | 220 | 1.45 | 3.5 | 2.5 |

TABLE 2

Comparison Example 2

| Density | Vdc | f | Line width | Density | Fog (%) | Dot (%) |
|---|---|---|---|---|---|---|
| D-1 | 300 | 2400 | 128 | 1.24 | 1.8 | 0.6 |
| D-2 | 350 | 2400 | 150 | 1.33 | 1.3 | 0.8 |
| D-3 | 400 | 2400 | 172 | 1.38 | 1.2 | 1.2 |
| D-4 | 450 | 2400 | 190 | 1.42 | 1.6 | 1.6 |
| D-5 | 500 | 2400 | 211 | 1.45 | 2 | 2 |

TABLE 3

Embodiment 1

| Density | Vdc | f | Line width | Density | Fog (%) | Dot (%) |
|---|---|---|---|---|---|---|
| D-1 | 300 | 2000 | 140 | 1.28 | 2.8 | 1 |
| D-2 | 350 | 2000 | 160 | 1.35 | 2.5 | 1.2 |
| D-3 | 400 | 2000 | 180 | 1.42 | 2 | 1.6 |
| D-4 | 450 | 2200 | 192 | 1.43 | 1.8 | 1.8 |
| D-5 | 500 | 2400 | 211 | 1.45 | 2 | 2 |

The development voltage Vdc as a parameter of the development bias has significant effects upon the density, line width, and fog, whereas the frequency has significant effects upon the fog and dot reproducibility. Further, increasing the frequency when the development contrast is low produces serious adverse effects upon the dot reproducibility.

The present invention is such an invention that uses the above described characteristics of the development voltage Vdc. In particular, the characteristics of the frequency of the development voltage which significantly affects the fog production and dot reproducibility are used. That is, when the development contrast is in the range higher than the standard level, the amount, by which the background fog is produced, can be reduced by increasing the frequency, while keeping the adverse effects of the increased frequency upon the dot reproducibility at a low level.

In the case of the method in which the transfer voltage and reverse transfer voltage of the development bias voltage are fixed in magnitude, and the image density is changed only by changing the ratio (duty ratio) of the duration of the transfer voltage relative to duration of the reverse transfer voltage, the duration of the transfer voltage increases in the range in which the set density is higher than the standard value, and the increase in the duration of the transfer voltage tends to increase the amount by which the background fog is increased. Therefore, the method in accordance with the present invention is particularly effective when applied to such a method.

As shown in the tables and figures, in Comparative Example 1, there was a tendency for the fog to increase as the density was set to a level higher than the central default value (standard value). In Comparative Example 2, the overall amount of the fog was smaller. However, when the density level was set to a level lower than the central default value, the dot reproducibility was worse (dot % was low), which resulted in the production of a faint image, which was a problem. In comparison, in the first embodiment, the frequency was increased only when the density was set to a level higher than the central default value. Therefore, the amount by which the background fog was produced could be reduced while maintaining the dot reproducibility.

Embodiment 2

In this embodiment, the characteristic of the frequency which has significant effects upon the fog and dot reproducibility, and the characteristic of the development voltage Vdc which affects the density, line width, and fog, are both used. In other words, not only is the frequency is increased when the density level is set to the value D-4 or D-5, that is, values higher than the standard density value, as in the first embodiment, but also, the development voltage Vdc is increased to a level higher than that in the first embodiment, when the density value is set to the value D-4 or D-5.

Table 4 shows the bias settings and the characteristics of the resultant images, in this second embodiment of the present invention. The relationship between the density value and fog, in this second embodiment, is shown in FIG. 3, and the relationship between the density value and dot reproducibility is shown in FIG. 4. The relationship between the density value and line width is shown in FIG. 5.

TABLE 4

| Embodiment 2 | | | | | | |
|---|---|---|---|---|---|---|
| Density | Vdc | f | Line width | Density | Fog (%) | Dot (%) |
| D-1 | 300 | 2000 | 140 | 1.28 | 2.8 | 1 |
| D-2 | 350 | 2000 | 160 | 1.35 | 2.5 | 1.2 |
| D-3 | 400 | 2000 | 180 | 1.42 | 2 | 1.6 |
| D-4 | 465 | 2200 | 200 | 1.43 | 2 | 2 |
| D-5 | 520 | 2400 | 220 | 1.45 | 2.2 | 2.5 |

As shown in the tables and figures, in this embodiment, the line width, amount of the fog, and dot reproducibility, were further improved.

In either of the preceding embodiments, the development density is controlled by changing the time average value of the bias voltage by changing the duty ratio of the AC voltage having a rectangular waveform. However, the present invention is also effectively applicable to a method which controls the development density by changing the magnitude itself of the DC voltage applied in combination with the AC voltage having a rectangular waveform, without changing the duty ratio.

The present invention is particularly effective when single component developer, that is, toner alone is used. However, the present invention is also applicable when two component developer comprising toner and carrier is used. Further, not only is the present invention applicable to a reversal developing method which adheres developer to the low potential level areas, that is, the areas of an electrostatic latent image on an image bearing member, which have been exposed to an optical image, but also it is also applicable, with effects similar to those obtained with the reversal developing method, to the so-called normal developing method which adheres developer to the high potential level areas, that is, the areas which have not been exposed to the optical image, of the electrostatic latent image on the image bearing member.

As is evident from the above described embodiments of the present invention, according to the present invention, the line width and image density can be adjusted in a wide range, in particular, in the range in which the density value is higher than the standard value, without adversely affecting the amount by which the fog is produced. Therefore, it is possible to obtain an image which is not only satisfactory in line with and image density, but also in dot reproducibility.

While the invention has been described with reference to the structures disclosed herein, it is not confined to the details set forth, and this application is intended to cover such modification or changes as may come within the purposes of the improvements or the scope of the following claims.

What is claimed is:

1. A developing apparatus comprising:

a rotatable developer carrying member for carrying a developer, wherein said developer carrying member is supplied with a developing voltage, including a superimposed DC voltage component and an AC voltage component, to develop an electrostatic latent image formed on an image bearing member; and switching means for switching a potential difference between a potential of the DC voltage component and a potential of an image portion of the electrostatic latent image, wherein a frequency of the AC voltage component increases with the potential difference.

2. A developing apparatus according to claim 1, wherein the developing voltage includes a first peak voltage for urging the developer toward the image bearing member and away from said developer carrying member, and a second peak voltage for urging the developer toward said developer carrying member and away from the image bearing member.

3. A developing apparatus according to claim 2, wherein a time period in which the first peak voltage is applied in one cyclic period of the developing voltage is made to increase beyond a predetermined time period with the increase of the potential difference.

4. A developing apparatus according to claim 3, wherein the developing voltage is substantially in the form of a rectangular waveform.

5. A developing apparatus according to claim 1, wherein when an image density of a developed image is made to be higher than a predetermined image density in accordance with an output of said switching means, the potential of the the DC voltage component is adjusted to increase the potential difference.

6. A developing apparatus according to any one of claims 1–5, wherein when the potential difference it not larger than a predetermined potential difference, the frequency of the AC voltage component is a substantially constant predetermined frequency.

7. A developing apparatus according to claim 1, wherein an absolute value of the potential of the image portion of the electrostatic latent image is smaller than an absolute value of a potential of a non-image portion of the electrostatic latent image.

8. A developing apparatus according to claim 1, wherein the potential of the DC voltage component is between a potential of an image portion of the electrostatic latent image and a potential of a non-image portion of the electrostatic latent image.

9. A developing apparatus according to claim 1, wherein the potential of the DC voltage component is switched to switch the potential difference.

10. A developing apparatus according to claim 1, wherein a potential of non-image portion of the electrostatic latent image is constant when the potential difference is larger than a predetermined value.

* * * * *